US010794096B2

(12) United States Patent
Hamacher et al.

(10) Patent No.: US 10,794,096 B2
(45) Date of Patent: Oct. 6, 2020

(54) SYSTEM COMPRISING A COMPONENT AND AN ACTUATING APPARATUS FOR THE COMPONENT

(71) Applicant: ILLINOIS TOOL WORKS INC., Glenview, IL (US)

(72) Inventors: Kai Hamacher, Marktheidenfeld (DE); Roland Och, Rottendorf (DE); Christian Beck, Roettingen (DE); Andreas Rudolf, Wuerzburg (DE); Joachim Oberst, Grossrinderfeld (DE); Johannes Karlein, Tauberbischofsheim (DE)

(73) Assignee: Illinois Tool Works Inc., Glenview, IL (US)

( * ) Notice: Subject to any disclaimer, the term of this patent is extended or adjusted under 35 U.S.C. 154(b) by 1184 days.

(21) Appl. No.: 15/035,771

(22) PCT Filed: Sep. 19, 2014

(86) PCT No.: PCT/US2014/056606
§ 371 (c)(1),
(2) Date: May 11, 2016

(87) PCT Pub. No.: WO2015/073119
PCT Pub. Date: May 21, 2015

(65) Prior Publication Data

US 2016/0290018 A1 Oct. 6, 2016

(30) Foreign Application Priority Data

Nov. 18, 2013 (DE) ..... 10 2013 112 705

(51) Int. Cl.
*E05B 85/10* (2014.01)
*E05B 77/42* (2014.01)
(Continued)

(52) U.S. Cl.
CPC ..... *E05B 85/103* (2013.01); *E05B 5/006* (2013.01); *E05B 77/42* (2013.01); *E05B 85/107* (2013.01); *E05B 85/12* (2013.01)

(58) Field of Classification Search
CPC . E05B 5/00; E05B 5/003; E05B 5/006; E05B 15/002; E05B 2015/0486;
(Continued)

(56) References Cited

U.S. PATENT DOCUMENTS 2,188,335 A * 1/1940 Claud-Mantle ..... E05B 83/247 292/214
2,201,444 A * 5/1940 Marsh ..... E05B 85/22 292/165
(Continued)

FOREIGN PATENT DOCUMENTS

CN 102061833 A 5/2011
DE 102008057933 B4 10/2012

OTHER PUBLICATIONS

ISR and WO for PCT/US2014/056606 dated Dec. 12, 2014.

*Primary Examiner* — Christine M Mills
(74) *Attorney, Agent, or Firm* — Quarles & Brady LLP

(57) ABSTRACT

A system including a component which can be mounted movably in or on an automobile and an actuating apparatus for the component, the actuating apparatus having a push-push mechanism which interacts with the component, it being possible for the component to be moved out of a closed position by manual exertion of a pressing force counter to the prestress of a spring into an unlocked position in order to unlock the push-push mechanism, out of which unlocked position the component is moved into a partially open position driven by the prestress of the spring, out of which partially open position the component can be moved into an open position by manual exertion of a pulling force.

10 Claims, 4 Drawing Sheets

Figure 1:
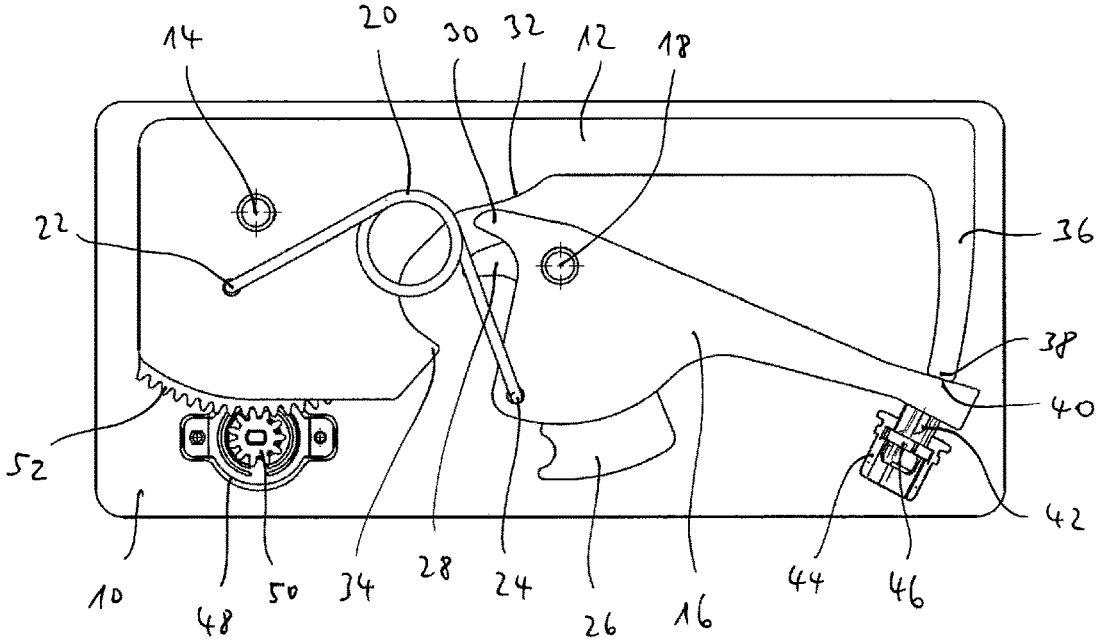

(51) Int. Cl.
*E05B 5/00* (2006.01)
*E05B 85/12* (2014.01)

(58) Field of Classification Search
CPC .. E05B 2015/0493; E05B 77/42; E05B 79/06; E05B 85/10; E05B 85/103; E05B 85/107; E05B 85/12; E05C 19/02; E05C 19/022; Y10T 292/0876; Y10T 292/57; Y10S 292/04; Y10S 292/61; Y10S 292/30; Y10S 292/31; Y10S 292/63
USPC ... 292/70, 336.3, DIG. 4, DIG. 30, DIG. 31, 292/DIG. 61, DIG. 63
See application file for complete search history.

(56) References Cited

U.S. PATENT DOCUMENTS 2,268,892 A * 1/1942 Nelson ..... E05B 85/22 292/164
2,599,054 A * 6/1952 Gates ..... E05B 5/003 292/348
2,750,217 A * 6/1956 Landholt ..... B64D 29/06 292/97
2,823,090 A * 2/1958 Roehm ..... A61G 15/14 312/333
2,886,364 A * 5/1959 Smith ..... B60J 7/1851 292/113
3,020,075 A * 2/1962 Johnstone ..... E05B 85/14 292/336.3
3,153,552 A * 10/1964 Sandor ..... E05B 85/14 292/336.3
3,153,553 A * 10/1964 Sandor ..... E05B 85/14 292/336.3
3,266,275 A * 8/1966 Atkinson ..... E05B 65/5269 70/70
3,694,017 A * 9/1972 Keeler, II ..... E05B 5/00 292/336.3
3,854,784 A * 12/1974 Hunt ..... G11B 15/6751 312/9.63
3,874,203 A * 4/1975 Bookout ..... E05B 65/0007 70/137
3,975,049 A * 8/1976 Niessner ..... B60J 7/1642 296/224
3,993,338 A * 11/1976 Cherbourg ..... B60J 5/06 292/336.3
4,025,094 A * 5/1977 Mitchell ..... E05B 5/00 292/87
4,072,332 A * 2/1978 Isaia ..... E05C 3/122 292/228
4,538,843 A * 9/1985 Harris ..... B64D 29/06 292/113
4,641,747 A * 2/1987 Mestdagh ..... G11B 33/0444 206/308.1
4,895,403 A * 1/1990 Osenkowski ..... E05B 85/107 16/412
5,123,687 A * 6/1992 Pfeiffer ..... E05B 1/0092 292/336.3
5,632,516 A * 5/1997 Schwab ..... E05B 85/18 292/336.3
6,095,573 A * 8/2000 Rozema ..... E05B 5/003 292/336.3
6,279,971 B1 * 8/2001 Dessenberger, Jr. ... E05B 41/00 244/129.4
6,318,771 B1 * 11/2001 Holloway ..... B60K 15/05 292/201
6,460,905 B2 * 10/2002 Suss ..... E05B 85/12 292/336.3
6,491,086 B2 * 12/2002 Bettio ..... E06B 9/54 160/276
6,598,913 B2 * 7/2003 Meinke ..... E05B 85/107 292/336.3
6,698,262 B2 * 3/2004 Wittwer ..... E05B 85/107 292/336.3
6,896,302 B2 * 5/2005 Belchine, III ..... E05B 1/0038 292/110
6,910,749 B2 * 6/2005 Mueller ..... E05B 17/0037 292/304
7,185,938 B2 * 3/2007 Beck ..... B60K 15/04 292/207
7,905,524 B2 * 3/2011 Migli ..... E05C 19/022 16/235
8,282,142 B2 * 10/2012 Fannon ..... E05B 79/12 292/336.3
8,282,175 B2 * 10/2012 Herper ..... E05F 1/105 292/DIG. 4
8,347,475 B2 * 1/2013 Wang ..... H05K 7/1409 254/120
8,353,553 B2 * 1/2013 Beck ..... B60K 15/05 296/97.22
8,443,553 B1 * 5/2013 Polewarczyk ..... E05B 81/77 16/412
8,474,925 B2 * 7/2013 Koenig ..... E05B 65/46 312/333
8,690,204 B2 * 4/2014 Lang ..... E05B 81/77 292/279
8,701,353 B2 * 4/2014 Patel ..... E05B 85/107 49/503
8,733,815 B2 * 5/2014 Kwon ..... E05B 81/06 296/50
8,786,401 B2 * 7/2014 Sobecki ..... E05B 85/103 340/5.72
8,833,813 B2 * 9/2014 Muller ..... E05B 85/16 292/336.3
8,919,047 B2 * 12/2014 Johnsrud ..... E05B 85/103 292/336.3
9,033,391 B2 * 5/2015 Frommann ..... B60K 15/05 296/97.22
9,062,478 B2 * 6/2015 Bingle ..... E05B 81/78
9,080,352 B2 * 7/2015 Aerts ..... E05B 85/103
9,103,143 B2 * 8/2015 Wheeler ..... E05B 85/00
9,187,937 B2 * 11/2015 Schryer ..... B60N 3/026
9,249,608 B2 * 2/2016 Lang ..... E05B 85/103
9,322,191 B2 * 4/2016 Muller ..... E05B 85/107
9,790,725 B2 * 10/2017 Leborgne ..... E05F 5/08
9,895,969 B2 * 2/2018 Alexander ..... B60K 15/05
10,280,658 B2 * 5/2019 Halliwell ..... E05B 85/107
10,378,254 B1 * 8/2019 Salter ..... E05B 81/76
10,435,924 B1 * 10/2019 Salter ..... B60R 25/243
10,435,926 B2 * 10/2019 Brown ..... E05B 85/103
10,487,547 B2 * 11/2019 Malvy ..... E05B 85/107
10,533,352 B2 * 1/2020 Betzen ..... E05C 19/022
10,550,611 B2 * 2/2020 Och ..... E05B 85/103
2002/0121786 A1 9/2002 Meinke
2003/0030289 A1 * 2/2003 Fisher ..... E05B 85/08 292/336.3
2004/0031301 A1 * 2/2004 Dominique ..... E05B 41/00 70/237
2005/0121924 A1 6/2005 Chanya
2007/0247042 A1 * 10/2007 Yuhara ..... B65D 11/12 312/330.1
2009/0178663 A1 * 7/2009 Filippi ..... E05C 19/022 126/192
2011/0115240 A1 5/2011 Mueller et al.
2011/0174102 A1 7/2011 Beck
2013/0170241 A1 * 7/2013 Lesueur ..... E05B 77/42 362/501
2014/0132012 A1 * 5/2014 Yoshino ..... E05B 85/103 292/336.3
2014/0265372 A1 * 9/2014 Smart ..... E05B 85/103 292/336.3
2017/0130493 A1 * 5/2017 Guerin ..... E05B 85/107
2017/0254124 A1 * 9/2017 Wilke ..... E05B 77/22
2017/0306662 A1 * 10/2017 Och ..... E05B 1/0038
2018/0148957 A1 * 5/2018 Och ..... E05B 85/103
2018/0274271 A1 * 9/2018 Och ..... E05B 81/04
2019/0118644 A1 * 4/2019 Beck ..... B60K 15/05
2019/0145134 A1 * 5/2019 Low ..... E05B 79/06
2019/0178001 A1 * 6/2019 Esterle ..... E05B 17/0041
2019/0218835 A1 * 7/2019 Karlein ..... E05B 81/28

(56) References Cited

U.S. PATENT DOCUMENTS

| | | | | |
|---|---|---|---|---|
| 2019/0242165 | A1* | 8/2019 | Gebel | E05B 85/107 |
| 2019/0257124 | A1* | 8/2019 | Low | E05B 85/103 |
| 2019/0390488 | A1* | 12/2019 | Salter | E05B 85/103 |

* cited by examiner

SYSTEM COMPRISING A COMPONENT AND AN ACTUATING APPARATUS FOR THE COMPONENT

RELATED APPLICATIONS

The present application is a National Phase of International Application Number PCT/US2014/056606, filed Sep. 19, 2014, and claims priority to German Application Number 10 2013 112 705.3, filed Nov. 18, 2013.

The invention relates to a system comprising a component which can be mounted movably in or on an automobile and an actuating apparatus for the component, the actuating apparatus having a push-push mechanism which interacts with the component, it being possible for the component to be moved out of a closed position by manual exertion of a pressing force counter to the prestress of a spring into an unlocked position in order to unlock the push-push mechanism, out of which unlocked position the component is moved into a partially open position driven by the prestress of the spring, out of which partially open position the component can be moved into an open position by manual exertion of a pulling force.

DE 10 2008 057 933 B4 discloses an actuating apparatus for a flap mounted pivotably on an automobile, in particular a filler-neck flap, having a push-push mechanism. The filler-neck flap is pressed manually out of a closed position into an unlocked position in which the push-push mechanism is unlocked. A spring of the push-push mechanism then moves the filler-neck flap into a partially open position, out of which it can be manually pivoted up into an open position. For closure, the filler-neck flap is again pressed in manually beyond the closed position, again resulting in the push-push mechanism being locked and the filler-neck flap being held in the closed position.

The known actuating apparatus has proved to be appropriate in practice in many cases, in particular for filler-neck flaps. There is sometimes a wish also for other components to be actuated with such actuating apparatuses, for example door handles terminating with the outer skin of a body of an automobile. In such applications, it may be undesirable that the door handle has to be closed manually from its open position and in particular pressed in beyond the closed position. It would be desirable if the door handle were to be moved back automatically into the closed position. However, there is a conflict of objectives since a spring for prestress of the door handle into the partially open position has to be more greatly dimensioned than, for example, a spring for prestress of the door handle out of the open position into the closed position.

Taking the described prior art as a starting point, the object on which the invention is based is to provide a system of the type stated at the outset which offers a high degree of comfort in different applications.

The invention achieves the object by means of the subject-matter of claim 1. Advantageous refinements can be found in the dependent claims, the description and the figures.

For a system of the type stated at the outset, the invention achieves the object in that tensioning means are provided which prestress the spring during the movement of the component out of the partially open position into the open position, with the result that the component can subsequently be moved out of the open position into the closed position without a counterforce by the spring.

The component can be, for example, a door handle of an automobile. In particular, it can be a door handle which terminates flushly with the outer skin of the body, with thus, in particular, no engagement recess or the like being provided in the body. The component can be pivotably or otherwise movably mounted on an automobile, for example also displaceable in parallel. The door handle can interact with a door lock in a manner known per se, with the result that the door lock is unlocked in the open position of the door handle and is locked again during the movement of the door handle into the closed position.

According to the invention, tensioning means are provided which (again) prestress, that is to say compress, the spring during the movement of the component out of the partially open position into the open position. For this purpose, use is made of the pulling force applied manually during the complete opening of the component. As a result, advantageously, the spring does not have to be compressed during a movement out of the open position into the closed position. The degree of comfort is increased. In particular, it is thereby possible that the prestress of the spring or of another spring element moves the component back out of the open position into the closed position. Thus, after the component has been released in the open position, the spring or the further spring element then causes the component to be moved automatically back into the closed position. The conflict of objectives described at the outset is resolved since the spring which prestresses the component into the partially open position has already been compressed during the movement of the component into the open position. An, if appropriate, more weakly dimensioned spring can thus move the component back into the closed position.

According to a further refinement, it can be provided that the tensioning means comprise a likewise pivotably mounted actuator, the door handle and actuator being mounted such that they can be pivoted about pivot axes which are different and parallel to one another, and the door handle being connected via the spring to the actuator, and a tappet of the push-push mechanism being arranged on the actuator, on the outer side of which tappet a control cam is formed, the tappet being surrounded, at least in the closed position and the unlocked position of the door handle, by a control ring of the push-push mechanism, which control ring is mounted rotatably and axially fixedly in a housing of the push-push mechanism, the control ring having, on its inner side, at least one control projection which is guided in the control cam of the tappet.

It can further be provided that

- the control cam comprises at least one axially parallel groove on the outer side of the tappet, it being possible for the at least one control projection of the control ring to be brought into engagement with the groove over an axial adjusting range of the tappet, as a result of which the control ring maintains its rotary position in the region of the groove when the tappet is moved axially,
- the control cam comprises a first deflecting face which runs obliquely with respect to the axis of the tappet between the groove and an actuating end of the tappet, which actuating end is remote from the free end of the tappet, said first deflecting face interacting with the at least one control projection of the control ring and rotating the control ring by a predefined angular amount when the tappet is moved into the housing by a predefined first stroke,
- the control cam comprises a locking recess which points toward the actuating end of the tappet at a circumferential spacing from the first deflecting face, which locking recess receives the at least one control projection of the control ring when the tappet is released after the first stroke, as a result of which the tappet is locked in a locked position after a return stroke in the housing, and the control cam comprises a second deflecting face which runs obliquely with respect to the axis of the tappet between the locking recess and the actuating end of the tappet, which second deflecting face interacts with the at least one control projection of the control ring when the tappet is moved further into the housing with a second stroke out of the locked position, as a result of which the control ring is rotated by a predefined second angular amount and the at least one control projection is aligned with the groove and the tappet can be moved out of the control ring.

Here, the door handle and the actuator are in particular connected or coupled to one another exclusively via the spring. The control projection of the control ring is guided in the control cam in order to implement the push-push function. The tappet can in particular be formed integrally with the actuator. Furthermore, a lock actuator can be provided which unlocks or locks the lock in the above-described manner, for example by means of a connection with a Bowden cable, as is known per se. The lock actuator can, for example, be mounted pivotably about the same pivot axis as the actuator, but independently of the actuator.

It is also possible that the tappet has three axially parallel grooves arranged with an equal circumferential spacing, first and second deflecting faces and locking recesses, and the control ring has, on the inner circumference, three control projections arranged with an equal spacing. The first and second deflecting faces and the locking recesses can be formed on radial elevations of the tappet. The axially parallel grooves can then be formed between adjacent elevations of the tappet. A design of the push-push mechanism as known from DE 10 2008 057 933 B4 is possible in principle.

According to a particularly practical refinement, the spring can be a leg spring or helical spring which is held fixedly with one end on the door handle and fixedly with its other end on the actuator. The leg spring or helical spring imparts the movement between the door handle and the actuator and can in this case, on the one hand, be prestressed during a manual movement of the door handle and, on the other hand, pivot, for example, the actuator and the door handle relative to one another during the relaxation of said spring.

According to a further refinement, it can be provided that the door handle and the actuator in each case have an actuating section, it being possible for the actuating sections to be brought into contact with one another, as a result of which the door handle, during its movement out of the closed position into the unlocked position, likewise moves the actuator between a closed position and an unlocked position, and as a result of which the actuator, during its movement out of the unlocked position into a partially open position, likewise moves the door handle between the unlocked position and the partially open position. The actuating section of the door handle can be formed, for example, on an actuating lever of the door handle which, at least in the closed position and the unlocked position, bears on the actuating section of the actuator. The actuating section of the actuator can be formed, for example, on the side of the actuator which is opposite the tappet and faces the door handle.

In the partially open position, the actuator can assume a pivoting position such that the tappet is situated outside the housing of the push-push mechanism. It can then be provided, furthermore, that the tensioning means in each case have at least one cam which is formed on the actuator and on the door handle, the cams interacting in such a way that the actuator, during a movement of the door handle out of the partially open position into the open position, is pivoted in such a way that the spring is prestressed. The cams in particular form stops for the relative movement of the door handle and actuator with respect to one another. For this purpose, the door handle and/or the actuator can in each case have two cams. Furthermore, it is possible that the tappet of the actuator, during a movement of the door handle out of the partially open position into the open position, enters into the housing of the push-push mechanism again, the at least one control projection of the control ring being received in a locking recess of the control cam, with the result that the tappet is locked in the housing in a locked position. The locking recess and the locking position can here be in particular the locking recess or locking position described above with respect to the control cam.

According to an alternative exemplary embodiment, the push-push mechanism can comprise:

a housing and a tappet which is mounted axially movably in the housing, with a control cam which is formed on its outside, the tappet protruding partially out of the housing via a housing opening in all axial positions and having an outer actuating end which interacts directly or indirectly with the component, the tensioning means comprising an inner housing which can be displaced axially in the housing and in which a control ring which surrounds the tappet is mounted axially fixedly and rotatably, the control ring having, on its inner side, at least one control projection which is guided in the control cam of the tappet, the spring being arranged, furthermore, in the inner housing, the spring being supported with one end on the tappet and with its other end on the inner housing and prestressing the tappet out of the housing, the inner housing having a tensioning rod which likewise interacts directly or indirectly with the component, is guided through an axial opening of the tappet and can be moved axially together with the inner housing relative to the tappet, the tensioning rod being driven by a movement of the component out of the partially open position into the open position in such a way that the inner housing moves with the tensioning rod relative to the tappet under the prestress of the spring.

It can then furthermore be provided that the control cam comprises at least one axially parallel groove, it being possible for the at least one control projection of the control ring to be brought into engagement with the groove over an axial adjusting range of the tappet, as a result of which the control ring retains its rotary position in the region of the groove when the tappet is moved axially, the control cam comprises a first deflecting face which runs obliquely with respect to the axis of the tappet on the tappet between the groove and the actuating end, which first deflecting face interacts with the at least one control projection of the control ring and rotates the control ring by a predefined angular amount when the tappet is moved into the housing by a predefined first stroke, the control cam comprises a locking recess which points toward the actuating end on the tappet at a circumferential spacing from the first deflecting face, which locking recess receives the at least one control projection when the tappet is released after the first stroke, as a result of which the tappet is locked in the housing in a locked position after a return stroke, the control cam comprises a second deflecting face which runs obliquely with respect to the axis of the tappet between the locking recess and the actuating end, which second deflecting face interacts with the at least one control projection when the tappet is moved further into the housing with a second stroke out of the locked position, as a result of which the control ring is rotated by a predefined second angular amount and the at least one control projection is aligned with the groove and the tappet can be moved into its position in which it can be extended the furthest.

The control projection of the control ring is again guided in the control cam in order to implement the push-push function. The tappet can interact in particular with the component in the closed position, unlocked position and the partially open position. During the movement between the partially open position and the open position, the tappet can be out of contact with the component or no longer interact therewith. In particular during this movement, however, the tensioning rod interacts with the component, with the result that, under the compression of the spring held in the inner housing with respect to the tappet, said inner housing can be drawn out of the housing. As a result, a prestressing of the spring is again achieved.

Again it is possible that the tappet has three axially parallel grooves arranged with an equal circumferential spacing, first and second deflecting faces and blocking recesses and the control ring has, on the inner circumference, three control projections arranged with an equal spacing. The first and second deflecting faces and blocking recesses can again be formed on radial elevations of the tappet. The axially parallel grooves can then again be formed between adjacent elevations of the tappet. A design of the push-push mechanism as known in principle from DE 10 2008 057 933 B4 is again possible. The tappet can have at least one annular recess against which the spring is supported. The control ring can be received in an inner annular recess of the inner housing. The inner housing and the housing can in each case have a hollow cylindrical basic shape. The spring can in particular be a helical spring. The, for example cylindrical, tensioning rod can extend as far as the bottom of the cup-shaped inner housing, it then being possible for the spring to surround the tensioning rod. The tensioning rod and the inner housing can in particular be formed integrally.

According to a further refinement, it is possible that the movement of the inner housing with the tensioning rod relative to the tappet leads, on account of the guidance of the at least one control projection of the control ring in the control cam of the tappet, to a rotation of the control ring in the inner housing in such a way that the at least one control projection is received in a locking recess of the control cam, with the result that the tappet is locked in the housing in a locked position. The locking recess and the locked position can again be the locking recess or locked position described above with respect to the control cam.

The tappet can have at least one projection on its outer side, which projection bears against at least one stop face of the housing in the partially open position. The stop face ensures that the tappet, during an extraction of the inner housing from the housing, cannot be moved beyond the stop. Consequently, the spring is compressed and thus prestressed.

Damping means can be provided which damp a movement of the component directly or indirectly. Any desired dampers, for example rotation dampers or linear dampers, are suitable in principle. They can also be free-running dampers.

Figure 2:
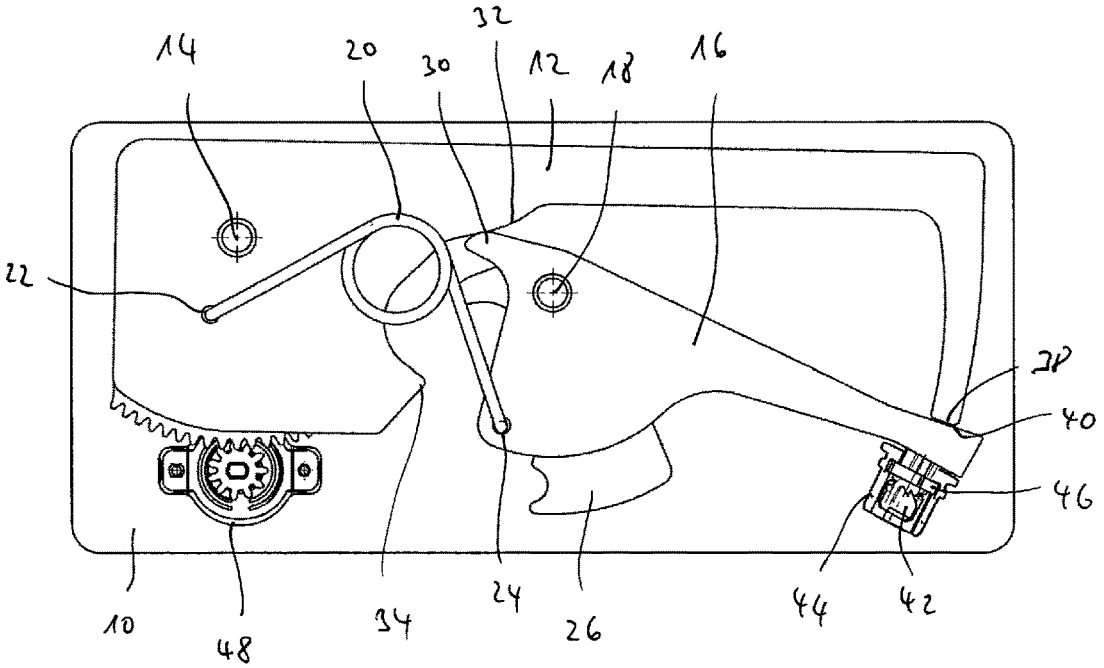
Figure 3:
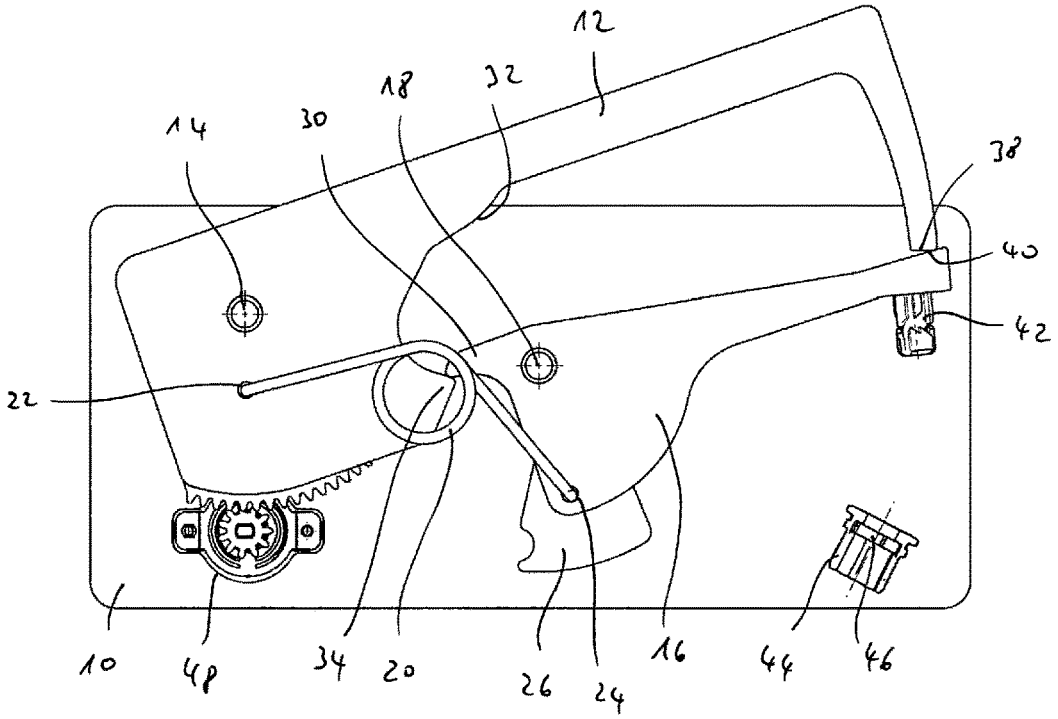
Figure 4:
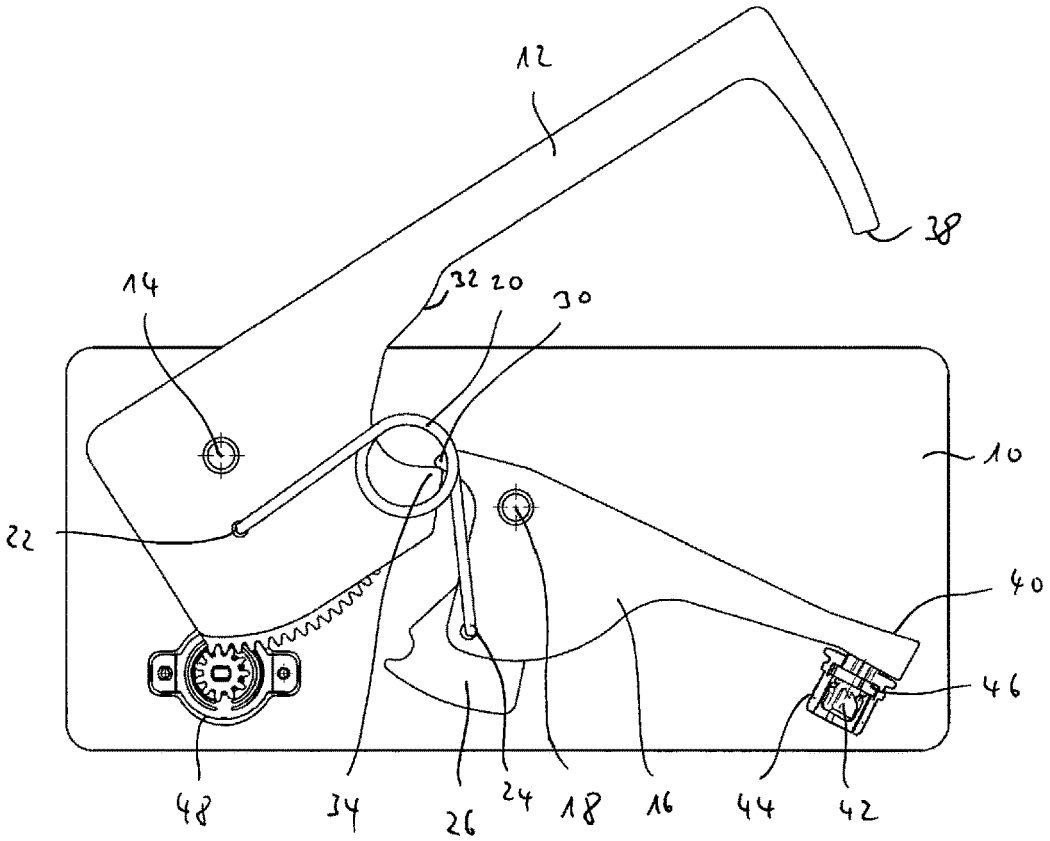
Figure 5:
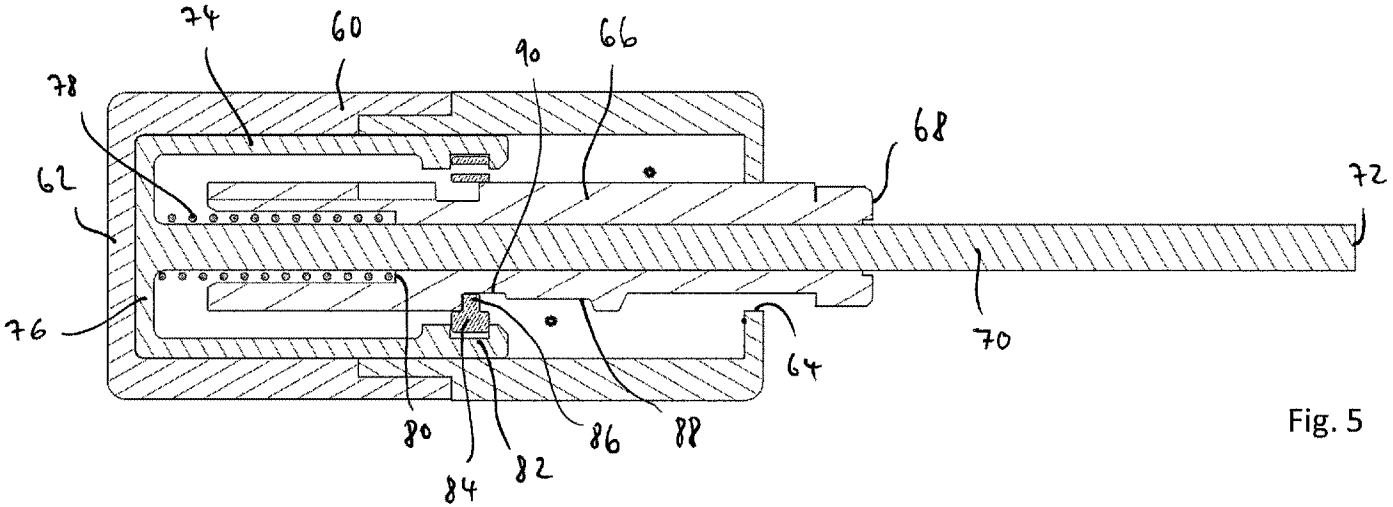
Figure 6:
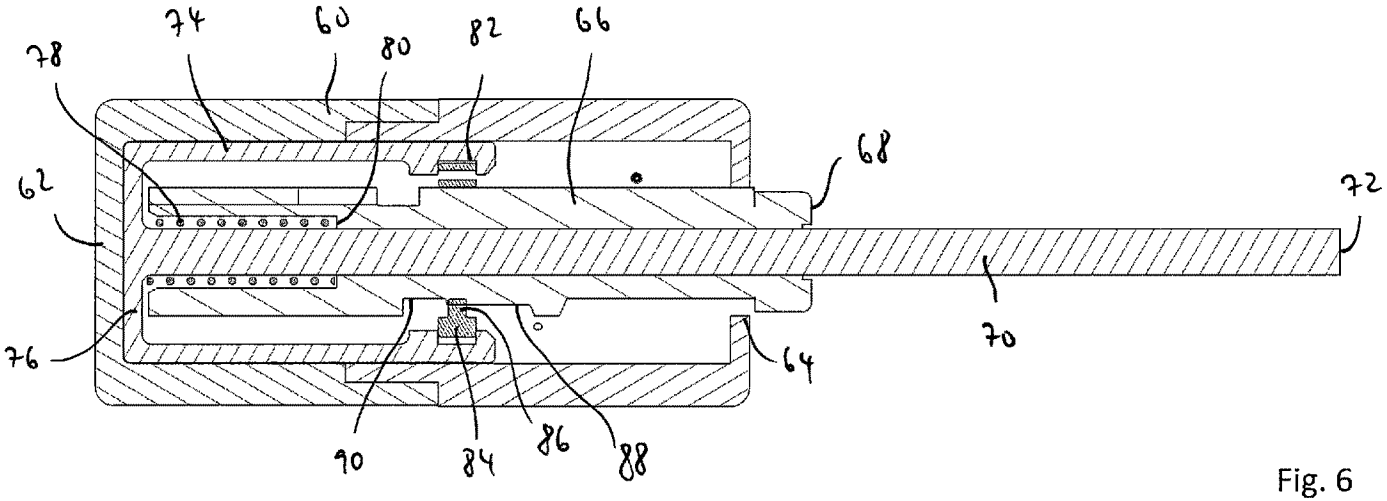
Figure 7:
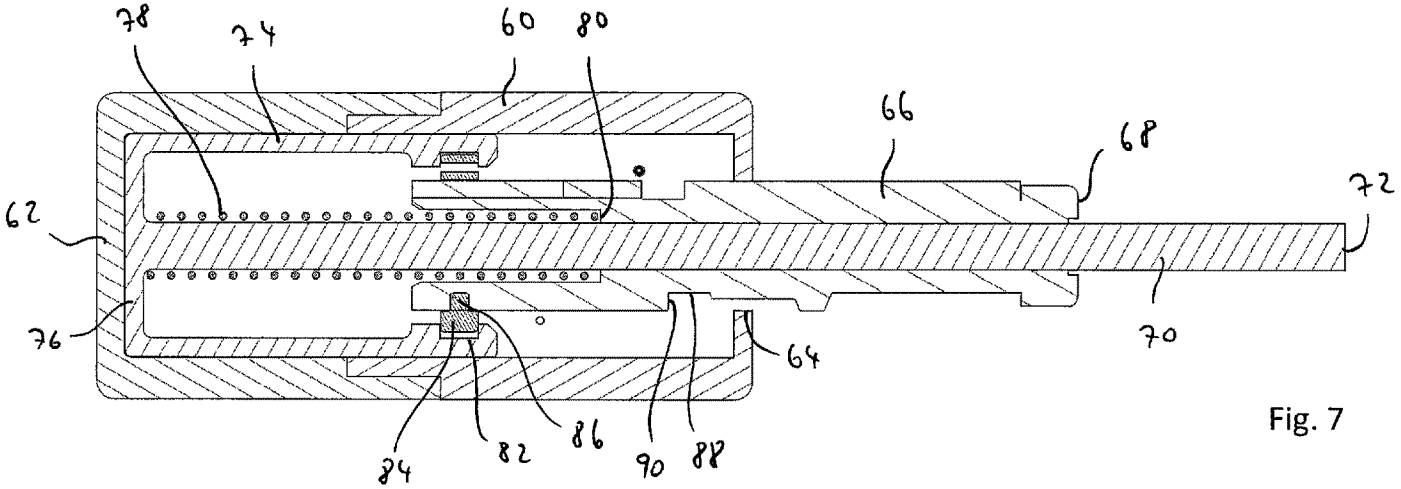
Figure 8:
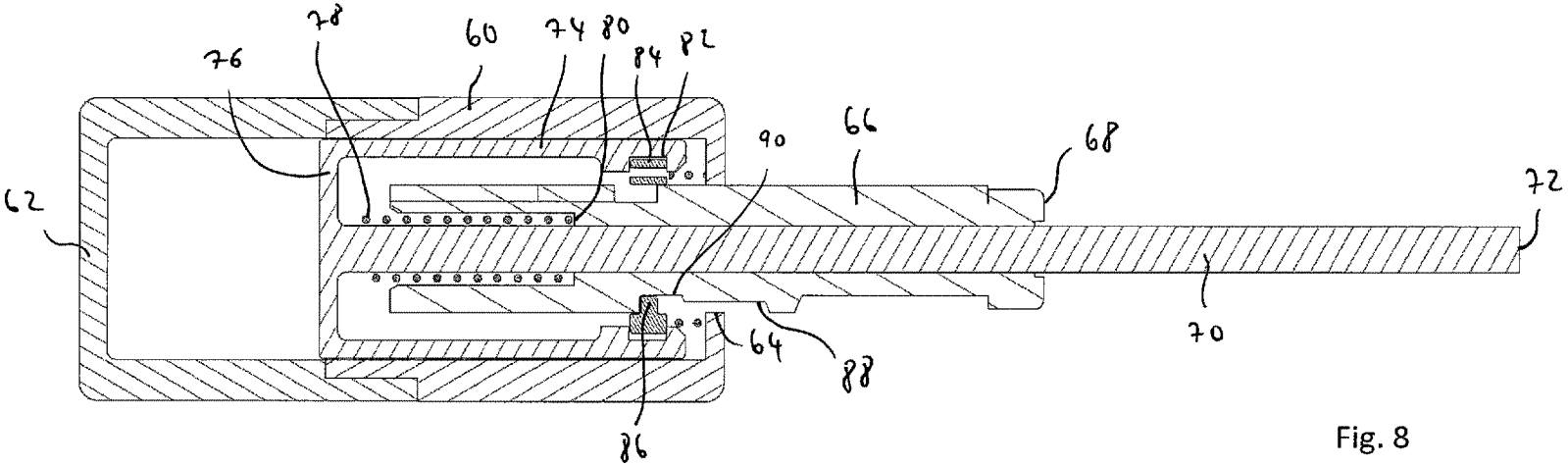

Exemplary embodiments of the invention will be described in more detail below with reference to figures, in which schematically:

FIG. 1 shows a system according to the invention in a partially sectioned side view in a first operating state, FIG. 2 shows the system from FIG. 1 in a second operating state, FIG. 3 shows the system from FIG. 1 in a third operating state, FIG. 4 shows the system from FIG. 1 in a fourth operating state, FIG. 5 shows a system according to the invention according to a further exemplary embodiment in a sectional view in a first operating state, FIG. 6 shows the system from FIG. 5 in a second operating state, FIG. 7 shows the system from FIG. 5 in a third operating state, and FIG. 8 shows the system from FIG. 5 in a fourth operating state.

Unless stated otherwise, identical reference numbers in the figures designate identical objects. FIGS. 1 to 4 are intended to illustrate a first exemplary embodiment of a system according to the invention. Reference number 10 represents a housing. A door handle 12, in the present case an outer door handle 12 which terminates flushly with the outer skin of an automobile body, is mounted pivotably about a pivot axis 14. An actuator 16 is mounted pivotably about a pivot axis 18 which runs parallel to and at a distance from the pivot axis 14. The door handle 12 and the actuator 16 are connected to one another via a leg spring 20 which is attached fixedly with one end 22 to the door handle 12 and is attached fixedly with its other end 24 to the actuator 16. Moreover, the leg spring 20 is tensioned freely between its ends 22, 24. Reference number 26 shows a lock actuator which, independently of the actuator 16, can likewise be pivoted about the pivot axis 18. For example, the lock actuator 26 is connected via a projection 28 to a Bowden cable which unlocks and locks a door lock of the door provided with the door handle, as is known per se. The actuator 16 has a cam 30. The door handle 12 has a first cam 32 and a second cam 34. Moreover, the door handle 12 has an actuating lever 36 whose free end forms an actuating section 38. It interacts with an opposite actuating section 40 of the actuator 16. On the side opposite the actuating section 40, a tappet 42 of a push-push mechanism is formed on the actuator 16. Moreover, the push-push mechanism comprises a housing 44 which is arranged fixedly on the housing 10 and a control ring 46 which is mounted axially fixedly and rotatably in the housing 44. The control ring 46 has one or more control projections on its inner side which is or are in engagement with a control cam formed on the outer side of the tappet 42. A push-push function is implemented in this way. Here, the control cam can be formed such as explained above in principle. Moreover, reference number 48 shows a damper having a damper gearwheel 50 mounted rotatably in a damping liquid, for example silicone. The damper gearwheel 50 meshes with a toothing 52 formed on the door handle 12.

FIG. 1 shows the closed position of the door handle 12 in which it terminates flushly with the outer skin of the body of the automobile. The spring 20 is prestressed and tends to pivot the actuator 16 in the counterclockwise direction about the pivot axis 18. This is prevented in FIG. 1 by virtue of the fact that the tappet 42 is locked on the control ring 46, with the result that the tappet 42 cannot exit from the housing 44 of the push-push mechanism. The spring 20 stresses the door handle 12 in this position additionally with its actuating section 38 against the actuating section 40 of the actuator 16, with the result that the door handle 12 is held in the closed position.

To unlock the push-push mechanism, the door handle 12 is pressed inwardly out of the position shown in FIG. 1, that is to say downward in FIG. 1 into an unlocked position shown in FIG. 2. In this unlocked position, the tappet 42 enters further into the housing 44 of the push-push mechanism with the rotation of the control ring 46 guided in the control cam of the tappet 42. Here, the tappet 42 is unlocked from the control ring 46. It can additionally be seen in FIG. 2 that the first cam 32 of the door handle 12 forms a stop for the cam 30 of the actuator 16. The lever ratios on the door handle 12 and the actuator 16 in respect of the respective attachment to the ends 22, 24 of the spring 20 and in respect of the stop formed by the cams 30, 32 are selected in such a way that the spring 20 is prestressed during the pressing of the door handle 12 into its unlocked position, or the pressing-in of the door handle 12 takes place counter to the prestress of the spring 20.

If the door handle 12 is released from the position shown in FIG. 2, the spring 20 pivots the actuator 16 in the counterclockwise direction about the pivot axis 18, the actuator 16, via the interaction of the actuating sections 38, 40, pivoting up the door handle 12 about the pivot axis 14 into the partially open position shown in FIG. 3. In particular, the force exerted by the prestress of the spring 20 in the region of the actuating sections 38, 40 is greater than the force exerted by the spring 20 on the door handle 12 via its end 22. The pivoting movement of the actuator 16, induced by the spring 20, is limited by the abutment of the cam 30 against the second cam 34 of the door handle 12. The damper 48 can be embodied in particular as a free-running damper, with the result that it displays no damping effect on the door handle 12 during this movement. It can be seen that the tappet 42 has exited from the housing 44 of the push-push mechanism.

In the partially open position shown in FIG. 3, the door handle 12 can be gripped manually and be pivoted up further into the open position shown in FIG. 4. As explained, in the position shown in FIG. 3, the second cam 34 of the door handle 12 forms a stop for the cam 30 of the actuator 16. This stop leads, during the manual movement of the door handle 12 into the open position shown in FIG. 4, to the actuator 16 being pivoted back in the clockwise direction about the pivot axis 18, to the tappet 42 again entering into the housing 44 of the push-push mechanism and, in particular, to the tappet 42 being locked on the control ring 46 again. As can be seen in FIG. 4, the spring 20 is also prestressed again during this movement. In parallel to this, the lock actuator 26 is pivoted about the pivot axis 18 and the door lock is thus unlocked, for example via a Bowden cable connected to the lock actuator 26. Here, the lock actuator 26 pivots in the clockwise direction about the pivot axis 18.

If the door handle 12 is released from the position shown in FIG. 4, the prestress of the spring 20 in this case ensures, via the connection of its end 22 to the door handle 12, that the door handle 12 is pivoted in the clockwise direction about the pivot axis 14 back into the closed position shown in FIG. 1. Here, the spring 20 can reduce its prestress only via a pivoting of the door handle 12, since the actuator 16 is locked via its tappet 42 in the housing 44 of the push-push mechanism and is thus blocked against pivoting about the pivot axis 18 apart from a small return stroke in the housing 44. Thus, in this case, not only does the spring 20 exert no counterforce, but the door handle moves actively back into the closed position. The lock actuator 26 likewise moves back into the starting position shown in FIG. 1, induced by a lock force, for example the tensioning of a Bowden cable.

FIGS. 5 to 8 are intended to illustrate a further exemplary embodiment of a system according to the invention, only the actuating apparatus for the component, but not the component itself, being shown in FIGS. 5 to 8 for reasons of clarity. The component can for example again be a door handle of an automobile. However, it can also be another component.

The actuating apparatus has a, for example, hollow cylindrical housing 60 which in the present case is composed of two sections. The housing 60 has a closed bottom 62. At its opposite end, the housing 60 has an opening 64 through which a tappet 66 projects in each axial position in the housing 60. The tappet 66 has an actuating end 68 which, at least in a closed position, an unlocked position and a partially open position of the component, interacts with the component, for example bears on a corresponding surface of the component, in a manner which is not shown in more detail. The tappet 66 has an axial through-bore through which a, for example, cylindrical tensioning rod 70 is guided in such a way that the tappet 66 and tensioning rod 70 are movable relative to one another in the axial direction. The tensioning rod 70 likewise has an actuating end 72 which, at least during a movement of the component between a partially open position and an open position, interacts therewith, in particular is connected to the component in such a way that it is driven by a movement of the component out of the partially open position into the open position. The tensioning rod 70 is part of an inner housing 74 mounted axially displaceably in the housing 60. In particular, the tensioning rod 70 is connected integrally to a closed bottom 76 of the inner housing 74. In the region of its end connected to the bottom 76 of the inner housing 74, the tensioning rod 70 is surrounded by a cylindrical helical spring 78 which is supported, on the one hand, on the bottom 76 of the inner housing 74 and, on the other hand, on an annular stop face 80 of the tappet 66. A control ring 84 is mounted axially fixedly and rotatably in an annular recess 82 of the inner housing 74. The control ring 84 has, on its inner side, at least one control projection 86 which is guided in a control cam 88 formed on the outer face of the tappet 66. Together with the control ring 84 and in particular at least one control projection 86, the control cam 88 forms a push-push mechanism. For this purpose, the control cam can be designed as explained above in principle.

FIG. 5 shows the starting position of the actuating apparatus in which the component, not shown, is in its closed position. The spring 78 is prestressed and tends to press the tappet 66 axially further out of the housing 60. This is prevented in that, as can be seen in FIG. 5, the control projection 86 of the control ring 84 is caught in a locking recess 90 of the control cam 88 and is thus locked. If the component is now pressed in manually such that via the interaction with the actuating end 68, it presses the tappet 66 into the housing 60 counter to the prestress of the spring 78, the control projection 86 comes out of the locking recess 90 and the tappet 66 is unlocked from the control ring 86. The component is now in an unlocked position. If the component is then released, it is moved into a partially open position through the interaction with the actuating end 68 of the tappet 66 and driven by the spring 78. As can be seen from a comparison of FIGS. 6 and 7, the tappet 66 is here pressed by the spring 78 out of the housing 60 into its position in which it is extended furthest axially. For this purpose, the control projection 86 of the control ring 84 is guided in an axially parallel groove of the control cam 88. In the position shown in FIG. 7, the component is in a partially open position out of which it can then be moved manually into an open position. In particular, for this purpose, the component is pulled further away from the tappet 66. Whereas in the movement state shown in FIGS. 5 to 7 the inner housing 74 remains with the tensioning rod 70 in an unchanged position on the bottom 62 of the housing 60, during a movement of the component out of the partially open position into the open position the tensioning rod 70 is pulled along via its actuating end 72, as a result of which the inner housing 74 is also pulled in the axial direction in the housing 60 in the direction of the housing opening 64 into the position shown in FIG. 8.

In FIG. 8, the component in its completely open position. It can be seen that the movement of the tensioning rod 70 with the inner housing 74 here takes place relative to the tappet 66, which is here not pulled axially further out of the housing 60. As explained, the tappet 66 in the state shown in FIG. 7 is already in its position in which it is extended furthest axially. This position can be defined by suitable stops, not shown in the figures, between the tappet 66 and the housing 60. The relative movement between the inner housing 74 with the tensioning rod 70 and the tappet 66 results in a compression and thus prestressing of the spring 78, as can be seen in FIG. 8. The control ring 84 is displaced, together with the inner housing 74, in the axial direction in the housing 60, the control projection 86 again being guided in the axial groove of the control cam 88 until the control projection 86 is again locked in the locking recess 90, as can be seen in FIG. 8. The push-push mechanism is thus locked again when the spring 78 is prestressed.

The tensioning rod 70 with the inner housing 74 and the tappet 66 coupled thereto via the control ring 84 can now again be pushed back out of the position shown in FIG. 8 into the starting position shown in FIG. 5 in the housing 60 without the spring 78 exerting a counterforce. The return movement in the housing 60 can take place manually or else driven by an additional spring element, for example an additional spring, which is not shown. Since the spring 78 does not exert a counterforce here, this spring can in principle be more weakly dimensioned than the spring 78.

The invention claimed is:

1. A system comprising a component mounted movably in or on an automobile and an actuating apparatus for the component, the actuating apparatus having a push-push mechanism which interacts with the component, the component movable out of a closed position by manual exertion of a pressing force counter to the prestress of a spring into an unlocked position in order to unlock the push- push mechanism, out of which unlocked position the component is moved into a partially open position driven by the prestress of the spring, out of which partially open position the component is moved into an open position by manual exertion of a pulling force, wherein tensioning means are provided which prestress the spring during the movement of the component out of the partially open position into the open position, with the result that the component is subsequently moved out of the open position into the closed position without a counterforce by the spring and the tensioning means includes a pivotably mounted actuator connected to the component via the spring.

2. The system as claimed in claim 1, wherein the prestress of the spring or of another spring element moves the component out of the open position back into the closed position.

3. The system as claimed in claim 1, wherein the component is a door handle which is mounted pivotably on the automobile, and the door handle terminates flushly with inner skin or outer skin of the automobile.

4. The system as claimed in claim 3, wherein the door handle and actuator are pivotably mounted to pivot about pivot axes which are different and parallel to one another, and a tappet of the push-push mechanism being arranged on the actuator, on the outer side of which tappet a control cam is formed, the tappet being surrounded, at least in the closed position and the unlocked position of the door handle, by a control ring of the push-push mechanism, which control ring is mounted rotatably and axially fixedly in a housing of the push-push mechanism, the control ring having, on its inner side, at least one control projection which is guided in the control cam of the tappet.

5. The system as claimed in claim 4, wherein the spring is a leg spring or helical spring which is held fixedly with one end on the door handle and fixedly with its other end on the actuator.

6. The system as claimed in claim 4, wherein the door handle and the actuator in each case have an actuating section, the actuating sections movable to be brought into contact with one another, as a result of which the door handle, during its movement out of the closed position into the unlocked position, likewise moves the actuator between a closed position and an unlocked position, and as a result of which the actuator, during its movement out of the unlocked position into a partially open position, likewise moves the door handle between the unlocked position and the partially open position.

7. The system as claimed in claim 4, wherein, in the partially open position, the actuator assumes a pivoting position such that the tappet is situated outside the housing of the push-push mechanism.

8. The system as claimed in claim 7, wherein the tappet of the actuator, during a movement of the door handle out of the partially open position into the open position, enters into the housing of the push-push mechanism again, the at least one control projection of the control ring being received in a locking recess of the control cam, with the result that the tappet is locked in the housing in a locked position.

9. The system as claimed in claim 4, wherein a first cam is formed on the actuator and a second cam is formed on the door handle, the cams interacting in such a way that the actuator, during a movement of the door handle out of the partially open position into the open position, is pivoted in such a way that the spring is prestressed.

10. The system as claimed in claim 1, wherein damping means are provided which damp a movement of the component directly or indirectly.

* * * * *